US010974362B2

(12) United States Patent
Naderer

(10) Patent No.: US 10,974,362 B2
(45) Date of Patent: Apr. 13, 2021

(54) DEVICE FOR MACHINING SURFACES

(71) Applicant: FerRobotics Compliant Robot Technology GmbH, Linz (AT)

(72) Inventor: Ronald Naderer, St. Florian (AT)

(73) Assignee: FerRobotics Compliant Robot Technology GmbH, Linz (AT)

( * ) Notice: Subject to any disclaimer, the term of this patent is extended or adjusted under 35 U.S.C. 154(b) by 591 days.

(21) Appl. No.: 15/569,704

(22) PCT Filed: Apr. 25, 2016

(86) PCT No.: PCT/AT2016/050111
§ 371 (c)(1),
(2) Date: Oct. 26, 2017

(87) PCT Pub. No.: WO2016/172751
PCT Pub. Date: Nov. 3, 2016

(65) Prior Publication Data

US 2018/0126512 A1 May 10, 2018

(30) Foreign Application Priority Data

Apr. 27, 2015 (DE) ..... 1 2015106480.4

(51) Int. Cl.
*B24B 21/00* (2006.01)
*B24B 21/12* (2006.01)
(Continued)

(52) U.S. Cl.
CPC ..... *B24B 21/12* (2013.01); *B24B 21/16* (2013.01); *B24B 21/20* (2013.01);
(Continued)

(58) Field of Classification Search
CPC .... B24B 41/005; B24B 27/0069; B24B 47/12
(Continued)

(56) References Cited

U.S. PATENT DOCUMENTS 4,841,683 A * 6/1989 Williams ..... B24B 21/02 451/304
5,394,653 A * 3/1995 Maier ..... B24B 5/167 451/303
6,645,349 B1 * 11/2003 Koivukunnas ..... D21G 1/0073 162/198

FOREIGN PATENT DOCUMENTS

DE 4030158 A1 3/1992
DE 4226708 C2 4/1994
(Continued)

OTHER PUBLICATIONS

Translation of DE19825698.*
Translation of JP2009016759.*

*Primary Examiner* — Joseph J Hail
*Assistant Examiner* — Shantese L McDonald
(74) *Attorney, Agent, or Firm* — Murphy, Bilak & Homiller, PLLC

(57) ABSTRACT

The invention relates to a device (100) for machining a surface of a workpiece (200*a*). According to one embodiment, the device (100) comprises a frame (160) and a roller carrier (401), on which a first roller (101) is rotatably supported and which is supported on the frame (160) in such a way that the roller carrier can be moved in a first direction (x). The device (100) comprises at least a second roller (103), which is supported on the frame (160), and a belt (102), which is guided at least around the two rollers (101, 103) and because of the tension of which a resulting belt force (102) acts on the roller carrier (401). The device (100) also comprises an actuator (302), which is mechanically coupled to the frame (160) and the roller carrier (401) in such a way that an adjustable actuator force (FA) acts between the frame (160) and the first roller (101) in the first direction (x). The belt (102) is guided by means of the second roller (103), or by means of the second roller (103)
(Continued)

and further rollers (101*a,* 101*b,* 121*a,* 121*b,* 105), in such a way that the resulting belt force (FB, FB') acting on the roller carrier (401) acts approximately in a second direction (y) orthogonal to the first direction (x) in the case of a target deflection of the actuator (302).

31 Claims, 9 Drawing Sheets

(51) Int. Cl.

| | |
|---|---|
| ***B24B 21/16*** | (2006.01) |
| ***B24B 21/20*** | (2006.01) |
| ***B24B 27/00*** | (2006.01) |
| ***B24B 41/00*** | (2006.01) |
| ***B24B 47/12*** | (2006.01) |
| ***B24B 49/08*** | (2006.01) |
| ***B24B 49/16*** | (2006.01) |

(52) U.S. Cl.
CPC ..... *B24B 27/0069* (2013.01); *B24B 41/005* (2013.01); *B24B 47/12* (2013.01); *B24B 49/08* (2013.01); *B24B 49/16* (2013.01)

(58) Field of Classification Search
USPC ..... 451/311, 46, 303, 304, 307, 426
See application file for complete search history.

(56) References Cited

FOREIGN PATENT DOCUMENTS

| | | | | | |
|---|---|---|---|---|---|
| DE | 19825698 | | * | 6/1998 | ..... B24B 21/12 |
| DE | 19825698 | A1 | | 12/1999 | |
| DE | 10013340 | A1 | | 9/2001 | |
| EP | 0477737 | A1 | | 4/1992 | |
| EP | 0705663 | A1 | | 4/1996 | |
| EP | 2974827 | A1 | | 1/2016 | |
| JP | H08108359 | | | 4/1996 | |
| JP | H10549 | A | | 1/1998 | |
| JP | 2002301659 | A | | 10/2002 | |
| JP | 2003220546 | A | | 8/2003 | |
| JP | 2009016759 | | * | 1/2009 | ..... H01L 21/304 |
| JP | 2009016759 | A | | 1/2009 | |

* cited by examiner (b)

(a)

(b)

(a)

DEVICE FOR MACHINING SURFACES

TECHNICAL FIELD

The invention relates to an apparatus for automated abrasive machining or smoothing of surfaces of workpieces, for example for the grinding of workpiece surfaces.

BACKGROUND

The finishing of surfaces in small-scale production is still carried out by hand in most cases. This takes a lot of time and must be performed by an experienced worker. The higher the quality demands placed on the finished surface, the more complex this processing step becomes. An example of this is the surface of a car bonnet, for which the quality requirements placed on the surface are relatively high. There is no adequate solution for producing such a surface quality in small series other than manual work with a (hand) grinding machine. The grinding results of known automatic grinders are often inadequate, their adjustment is highly time consuming and they often require long run-in and run-out areas to prevent irregularities from arising on the finished final surface. These irregularities arise due to vibrations in the grinding belt or to the sluggish regulation of the contact force. The contact force is the force with which the grinding belt acts on the workpiece surface. The publication JP S63-089263 describes a device that controls the contact force by means of a suitable bearing. Because of the high inertial mass of the grinding machine, however—the inertia—inevitably leads to the phenomena described above.

The underlying object of the invention is thus to provide a device which enables elaborate grinding or grinding tasks to be performed, partially or fully automated, with improved quality.

SUMMARY

The mentioned object can be achieved, for example, with an apparatus according to claim 1 or with a method according to claim 9 and with a system according to claim 12. Various embodiments and further developments are the subject of the dependent claims.

Hereinafter an apparatus for processing a surface of a workpiece is described. According to one embodiment, the apparatus includes a frame and a roller carrier on which a first roller is rotatably supported and which itself is slidably supported on the frame along a first direction. The device comprises at least a second roller which is supported on the frame and a belt which is guided at least around the two rollers and whose tension results in a belt force that acts on the roller carrier. The apparatus further includes an actuator that is mechanically coupled to the frame and the roller carrier in such a way that an adjustable actuator force is applied between the frame and the first roller along the first direction. The belt is, with the aid of the second roller—or with the aid of the second roller and further rollers—guided in such a manner that the resulting belt force acting on the roller carrier acts, at a desired deflection of the actuator, approximately in a second direction orthogonal to the first direction.

Further, a method for the surface machining of a workpiece is described. According to one embodiment of the method, an apparatus is used comprising a frame, a roller carrier on which a first roller is rotatably supported and which itself is slidably supported to the frame along a first direction, an actuator mechanically coupled with the frame and the roller carrier, and a belt which is guided at least around the first roller, the belt exerting a resulting belt force on the roller carrier. The method thereby comprises positioning the workpiece on the first roller, measuring a contact force between the first roller and the workpiece, and adjusting a contact force between the first roller and the workpiece by adjusting a force acting between the frame and the actuator. While positioning the workpiece this is positioned relative to the apparatus such that the deflection of the actuator corresponds to its desired deflection. At the desired deflection, the resulting belt force acting on the roller carrier acts approximately in a second direction which is orthogonal to the first direction. The retroactive effect of the belt force on the actuator can thus theoretically be reduced to zero.

Further, a system for robot-supported surface machining of workpieces is described. In accordance with one embodiment, the system includes a machining device and a manipulator for the positioning of the workpiece relative to the machining device. This comprises a frame and a roller carrier on which a first roller is rotatably supported, the roller carrier being slidably supported on the frame along a first direction. The machining device comprises at least a second roller which is supported on the frame and a belt which is guided at least around the two rollers, and due to the tension of which a resulting belt force acts on the roller carrier. The machining device further includes an actuator that is mechanically coupled with the frame and the roller carrier such that an adjustable actuator force acts between the frame and the first roller along the first direction. The belt is guided, with the aid of the second roller—or with the aid of the second roller and further rollers—such that the resulting belt force acting on the roller carrier, at a desired deflection of the actuator, approximately acts in a second direction that is orthogonal to the first direction.

BRIEF DESCRIPTION OF THE DRAWINGS

The invention is explained in greater detail below with reference to the examples illustrated in the figures. The drawings are not necessarily to scale and the invention is not limited to the illustrated aspects. Emphasis instead being placed upon illustrating the principles underlying the invention. The figures show.

In the figures, like reference numerals designate the same or similar components each having the same or similar meaning.

DETAILED DESCRIPTION

The examples of the invention described herein will be described in connection with a belt grinding device 100. Other applications of the invention, for example, for surface coating or for polishing surfaces, are also possible.

Figure 1:
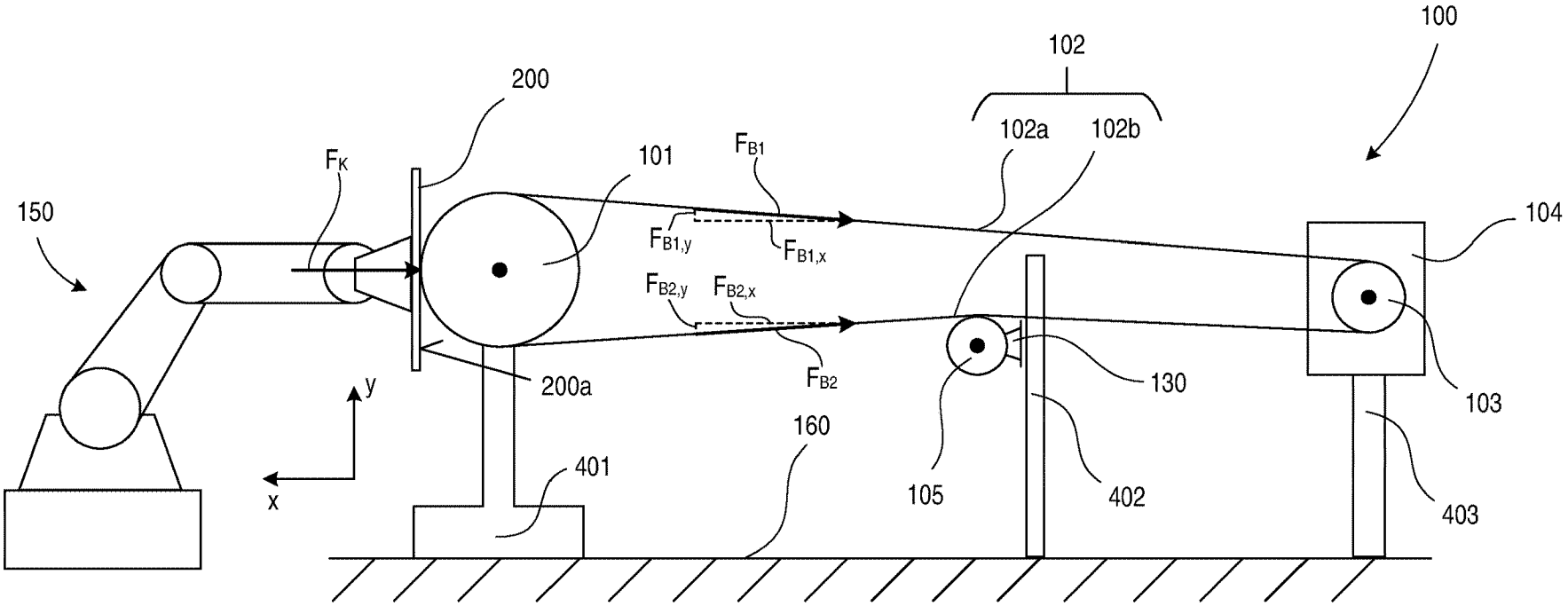
FIG. 1 shows a belt grinding device, in which the contact force between the workpiece and grinding belt is produced with the help of a manipulator.

The finishing of technical and optically high-quality surfaces requires a very high degree of precision in the production. Adherence to the required accuracy is made more difficult by the fact that the condition of the workpiece surface 200*a* changes during the processing period. Therefore, the finishing of surfaces, in particular for small series, is mostly carried out by hand in many fields. An example of a known grinding device 100 is illustrated in FIG. 1. The grinding device 100 is stationary and has a rotating grinding belt 102 which is guided over at least two rollers 101, 103. In the present example it is assumed that the belt rotates in the clockwise direction. The grinding belt 102 is tensioned by a tensioning element 105 (tension roller), which is supported by a linearly moveably suitable bearing 130 (for example by means of a slide bearing). The components (rollers 101 and 103, tensioning element 105) are connected by means of one or more carriers 401, 402, 403 with a frame 160 (such as a machine bed or a housing part).

For machining, the surface to be machined 200*a* of a workpiece 200 is pressed against the grinding belt 102 in the area of the first roller 101 while the grinding belt 102 is in motion. The necessary contact force $F_K$ (grinding force) can, for example, be manually adjusted or with the aid of a manipulator 150 that holds the workpiece. The manipulator 150 may be, for example, a standard industrial robot (with six degrees of freedom). Alternatively, however, other manually or mechanically actuated clamping and/or pressing devices can be used as a manipulator. Due to the contact force $F_K$, friction occurs between the work surface 200*a* and the grinding belt 102 resulting in the abrasion of material. Main factors affecting the processing result include the contact force $F_K$ per surface area (contact surface area on which grinding belt 102 and the surface of the workpiece 200*a* touch), hereinafter also referred to as contact pressure, and the rotational speed of the grinding belt 102. As the contact surface area between the workpiece and grinding belt 102 does not usually change significantly during a grinding operation, contact pressure and contact force $F_K$ are de facto proportional. In the area of corners and edges the contact force (i.e., its desired value) may be reduced due to the smaller contact surface area.

For a uniform grinding result, a correct adjustment (i.e., control) of the contact force $F_K$ throughout the entire machining process is desirable. A force control by the generally "rigid" manipulator in known automated grinding devices has proven to be difficult, especially when placing the workpiece 200 on the grinding belt. In general, transient disturbances (force peaks) in the contact force $F_K$ are very difficult to compensate by conventional means of control. This is usually a consequence of the inertia of the moving parts of the manipulator 150 and of limitations in the actuators (minimum dead time, maximum force or torque, etc.). Insufficient force control results in inhomogeneous grinding patterns with chatter marks. Chatter marks are surface irregularities caused by insufficient control of the contact force $F_K$. In areas in which has a higher contact force $F_K$ (temporarily) acts, cavities in the workpiece surface 200*a* are caused by greater material abrasion. At those points at which a lower contact force $F_K$ is temporarily prevalent, less material is removed and elevations remain. An experienced worker can compensate these inaccuracies when grinding by hand. When the workpiece surface 200*a* is placed on the grinding belt 102 automatically, in particular with the aid of a manipulator 150, these inaccuracies cannot be easily compensated. Due to the high inertia of the manipulator 150, adjustment to the prevailing grinding situation entails large time delays. In addition, the manipulator 150 can oscillate to varying degrees around its predefined desired position, which can lead to a non-uniform grinding pattern.

Instead of moving the workpiece 200 by means of a manipulator, it is also possible to clamp the workpiece 200 and to keep the grinding machine movable. In this case the actuator, with which the grinding force is controlled, would be coupled with the grinding machine, so that the grinding machine presses against the (stationary) workpiece. Also in this case there is the problem that the mass of the grinding machine, and thus its inertia, is relatively large and thus the same problem exists as in the above-described variation.

Figure 2:
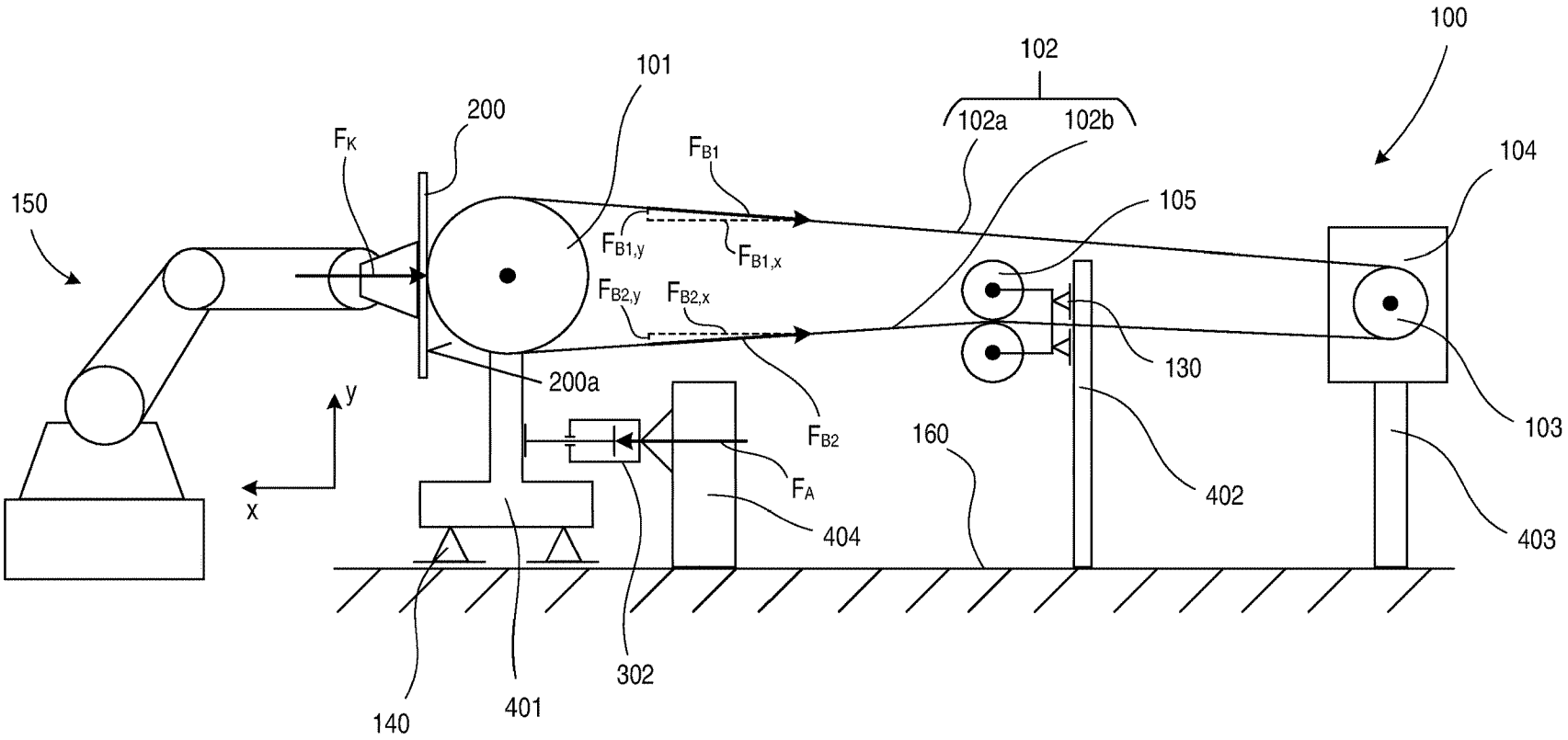
FIG. 2 shows a belt grinding device according to an embodiment of the invention with resilient bearing of a first roller of the belt grinding device.

In the example shown in FIG. 2, the workpiece 200 is held and positioned by a manipulator 150. However, the manipulator 150 requires only a simple position control, the contact force control is—as described below—implemented in the grinding machine 100. Therefore relatively cheap manipulators (e.g. industrial robots) can be used, which can hold the workpiece at a desired position and can move it along a desired trajectory. In particular, no expensive force or torque sensors are needed in the joints of the manipulator. The actuator 302 used for the force control can be a simple linear actuator in this example, such as an actuator with low friction and passive compliance. Pneumatic cylinders, pneumatic muscles, air bellows, as well as electric direct drive (without gears), for example, are possible. In the present example, a pneumatic cylinder is used as actuator 302.

The actuator 302 does not act on the grinding machine 100 as a whole, but only on those rollers of the of the grinding machine 100 that press against the workpiece while in operation (i.e., on the roller 101). The roller 101 is (via the roller carrier 401) linearly slidably supported on the frame 160 (linear guide 140). The actuator 302 acts between roller carrier 401 and frame 160. In the present example, the actuator is supported on the roller carrier 401 and on a further carrier 404 which is rigidly connected to the frame 160. In accordance with the control of the actuator 302, an actuator force $F_A$ is applied to the roller 101 operating along the movement direction (x-direction) of the linear guide 140. Due to the comparatively small mass of the first roller 101 (and the roller carrier 401) only low inertia forces arise on the actuator 302.

Beyond this, the grinding device shown in FIG. 2 has the same structure as the grinding device in the previous example of FIG. 1. The second roller 103 is unslidably mounted via the (roller) carrier 403 to the frame 160. In this context, unslidably does not mean that the position of the roller 103 is unchangeable, for example for the purpose of setting a proper tension on the grinding belt. During operation of the device (e.g. during a grinding process), however, the position of the roller 103 does not change. The roller 103 is driven (motor 104), whereas the roller 101 serves only as a deflection roller. The grinding belt 102 is led around both rollers 101 and 103. As in the example of FIG. 1, a tensioning device for adjusting a bias tension of the grinding belt can be provided. The tensioning device may comprise, for example, one or more tension rollers 105 which are located on the belt 102 and which can be moved at approximately a right angle to the grinding belt 102 in order to tension the grinding belt 102. In the present example, the tension rollers 105 are mounted by means of a linear guide 130 on the roller carrier 402 which in turn is rigidly connected to the frame 160. The initial tension can be generated, for example, by means of a spring acting between the roller carrier 402 and the tension roller (or tension rollers) 105.

The forces acting in the grinding belt 102 are designated in FIG. 2 as belt forces $F_{B1}$ (force in the upper portion 102*a* of the belt 102), and $F_{B2}$ (force in the lower part 102*b* of the belt 102) whereas each of the two forces $F_{B1}$ and $F_{B2}$ comprise a force component in x-direction ($F_{B1,x}$ and $F_{B2,x}$) and a force component in y-direction ($F_{B1,y}$ and $F_{B2,y}$). The resulting belt force $F_{B,y}$ that acts on the roller 101 in the y direction (i.e. $F_{B,y}=F_{B1,y}+F_{B2,y}$) is absorbed by the linear guide 140 and the tensioning device. The resulting belt force $F_{B,x}$ that acts on the roller 101 in the x direction (i.e. $F_{B,x}=F_{B1,x}+F_{B2,x}$), however, also acts on the actuator 302 and thus against the actuator force $F_A$. For the contact force $F_K$, in the stationary case, $$F_K=F_A+F_{B,x} \tag{1}$$

applies This means that the resulting belt force $F_{B,x}$ must be taken into account when controlling the contact force $F_K$. For this, the belt force $F_{B,x}$ must be known. This may either be measured (for example, by means of a force sensor in the tensioning device and the drive torque of the motor), or estimated with the aid of a mathematical model. By correctly deflecting the grinding belt, however, the influence of the belt forces $F_{B1}$, $F_{B2}$ on the contact force $F_K$ can be reduced (in the ideal case, eliminated). In other words, actuator force $F_A$, and the resulting belt force $F_{B,X}$ in the operating direction (x-direction) of the actuator 302 are decoupled. An example of a suitable deflection of the grinding belt 102 is illustrated in FIG. 3.

Figure 3:
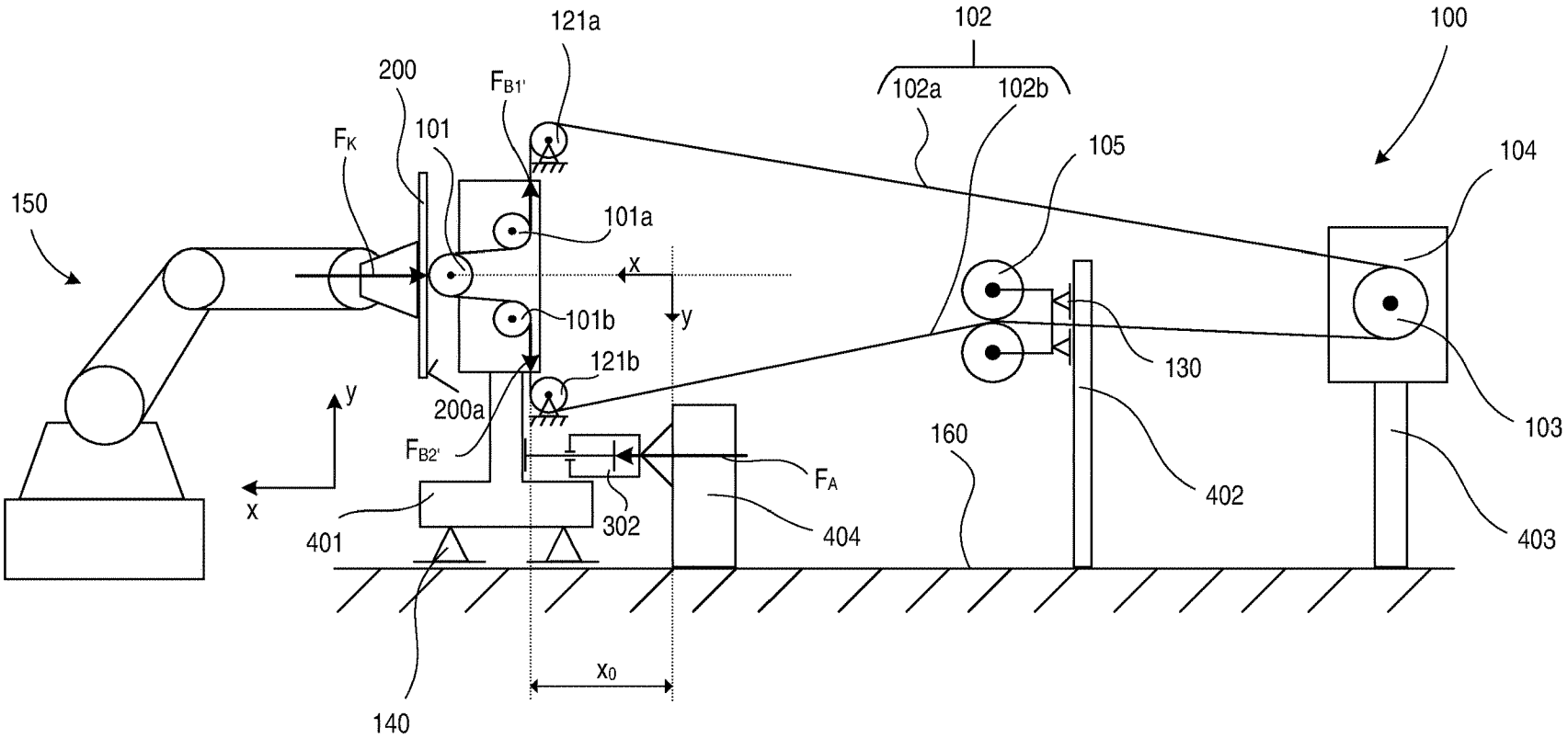
FIG. 3 shows a belt grinding device according to an embodiment of the invention, wherein the first roller is supplemented with a roller set.

The example shown in FIG. 3 essentially corresponds to the previous example of FIG. 2, wherein in addition to the deflection roller 101, two other deflection rollers 101*a* and 101*b* are arranged on the roller carrier 401. Furthermore, two more deflection rollers 121*a*, 121*b* are provided which are unslidably mounted on the frame 160. The roller carrier 401 with the rollers 101, 101*a* and 101*b* is supported on the frame 160, as in the previous example, by means of the linear guide 140, wherein the linear guide permits a movement of the roller carrier 401 in the horizontal direction (x direction) and blocks other degrees of freedom. The deflection rollers 101*a* and 101*b* and the deflection rollers 121*a* and 121*b* are arranged so that—at a nominal deflection $x_0$ (target displacement) of the actuator 302—the resulting belt force $F_B'$ acting on the roller carrier 401 stands (at least approximately) in a right angle to the actuator force $F_A$. In other words, the x-components $F_{B,x}'$ of the resultant belt force $F_B'$ is approximately zero, wherein the linear guide 140 only permits a force transmission from the actuator 302 to the roller carrier 401 in the x-direction. As in the previous example, the resultant belt force $F_B'$ equals the sum of the belt force $F_{B1}'$ in the upper part 102*a* of the belt 102 and the belt force $F_{B2}'$ in the lower part 102*b* of the belt 102 ($F_B'=F_{B1}'+F_{B2}'$). When the deflection x of the actuator 302 corresponds to the nominal deflection $x_0$, this is referred to as operating point $x=x_0$.

Figure 4:
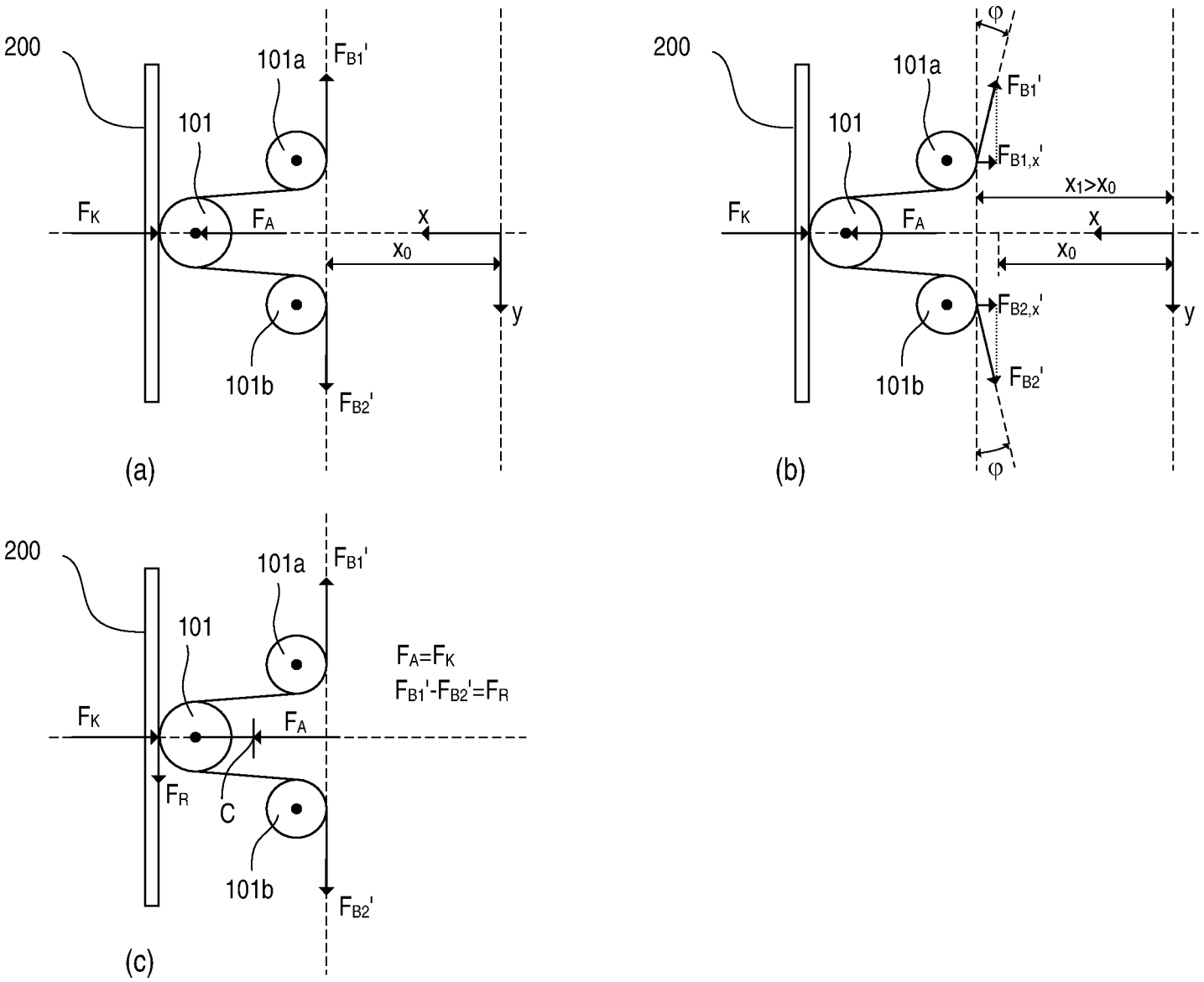
FIG. 4 shows a detail of the device of FIG. 3 for better illustration of the forces acting on the rollers in the operating point (FIGS. 4*a* and 4*c*) and outside of the operating point (FIG. 4*b*).

FIG. 4 shows the forces acting on a roller carrier 401 (for example, from FIG. 3) in detail. FIG. 4*a* shows a displacement $x=x_0$ of the actuator at an operating point. FIG. 4*c* is a variant of FIG. 4*a* in which the actuator force $F_A$ acts exactly in the center of the roller carrier 401 such that all forces in the operating point are cancelled and no torque acts on the roller carrier 4. At a displacement $x\neq x_0$ of the actuator, the x-component $F_{B,x}'$ of the belt force $F_B'$ is no longer zero, but is instead $F_{B,x}'=F_B'\cdot\sin(\varphi)$, wherein $\varphi$ is the angular deviation of the force vector $F_B'$ with respect to the y-direction. This means that, at an angular deviation of 3 degrees around 5% of the resultant belt force $F_B'$ would react in the x-direction and thus to the actuator 302 as a disturbing force. When designing the grinding machine it can be constructed such that the angular deviation $\varphi$ in operation is so small that this disturbing force remains negligible. In this context it should be noted that (only) the force $F_A$ exerted by the actuator 302 (and thus the contact force $F_K$) is regulated. The actual deflection x of the actuator 302 during the grinding operation depends on the position of the workpiece 200, which in turn is set by the manipulator 150. However, the manipulator is position-controlled and can position the workpiece such that the actuator deflection x corresponds to the desired operating point $x_0$, at which the deviation angle cp is zero.

In FIG. 4*a* and FIG. 4*b*, the relevant forces on the rollers 101, 101*a*, 101*b* supported on the roller carrier 401 are shown once again in detail. For clarity, only the rollers 101, 101*a* and 101*b* that are supported slidably in the x direction, as well as the grinding belt 102 and the workpiece 200 are shown. The position of the rotational axes of the rollers 101, 101*a* and 101*b* relative to one another is fixed and does not change during operation. The actuator force $F_A$ and the contact force $F_K$ act in x-direction on the rollers (actuator and contact forces in other directions are absorbed by the linear guide 140). In FIG. 4*a*, the actuator deflection x corresponds to the operating point $x_0$ and consequently the belt forces $F_{B1}'$ and $F_{B2}'$ acting on the rollers 101*a* and 101*b* are oriented in the vertical direction and have no components in the horizontal direction (x-direction). Consequently, actuator force $F_A$ and the resulting belt force $F_B'=F_{B1}'+F_{B2}'$ are decoupled. This means that the belt forces $F_{B1}'$ and $F_{B2}'$ do not react on the actuator 302. In FIG. 4*b* a situation is shown in which the workpiece is moved out of the operating point, that is, the actuator deflection is not equal to $x_0$ and, consequently, the belt forces $F_{B1}'$ and $F_{B2}'$ acting on the rollers 101*a* and 101*b* are no longer (exclusively) oriented in a vertical direction but are instead tilted at an angle $\varphi$ with respect to the y-direction. This has—as already mentioned—the consequence that the resulting belt force $F_B'$ has a component in the x-direction i.e. $F_{B,x}'=|F_B'\sin(\varphi)$. This force component $F_{B,x}'$ reacts on the actuator and is either compensated by the force control or a control error in the amount of the belt force component $F_{B,x}'$ arises. As long as the workpiece is guided and positioned by a manipulator 150, it can be ensured that the workpiece will always be located at the operating point and, consequently, that the actuator force $F_A$ and the belt forces $F_{B1}'$, $F_{B2}'$ acting on the roller 101 will be decoupled. Here it should be mentioned again that the actuator 302 only acts on the roller carrier 401 that carries the deflection rollers 101, 101*a*, 101*b*, and not on the entire grinding device. In the variation of FIG. 4*c*, the actuator force engages exactly at the center C, so that the tensioning forces $F_{B1}'$, $F_{B2}'$ and the friction force $F_R$ cancel each other. Similarly, contact force $F_K$ and actuator force $F_A$ cancel each other. The fact that the "lever" between the point of engagement of the respective forces $F_{B1}'$, $F_{B2}'$ and $F_R$ and the center C is always the same, no torques are applied (the sum of all torques is zero). Thus, no—potentially disturbing—torque load acts on the actuator.

Figure 5:
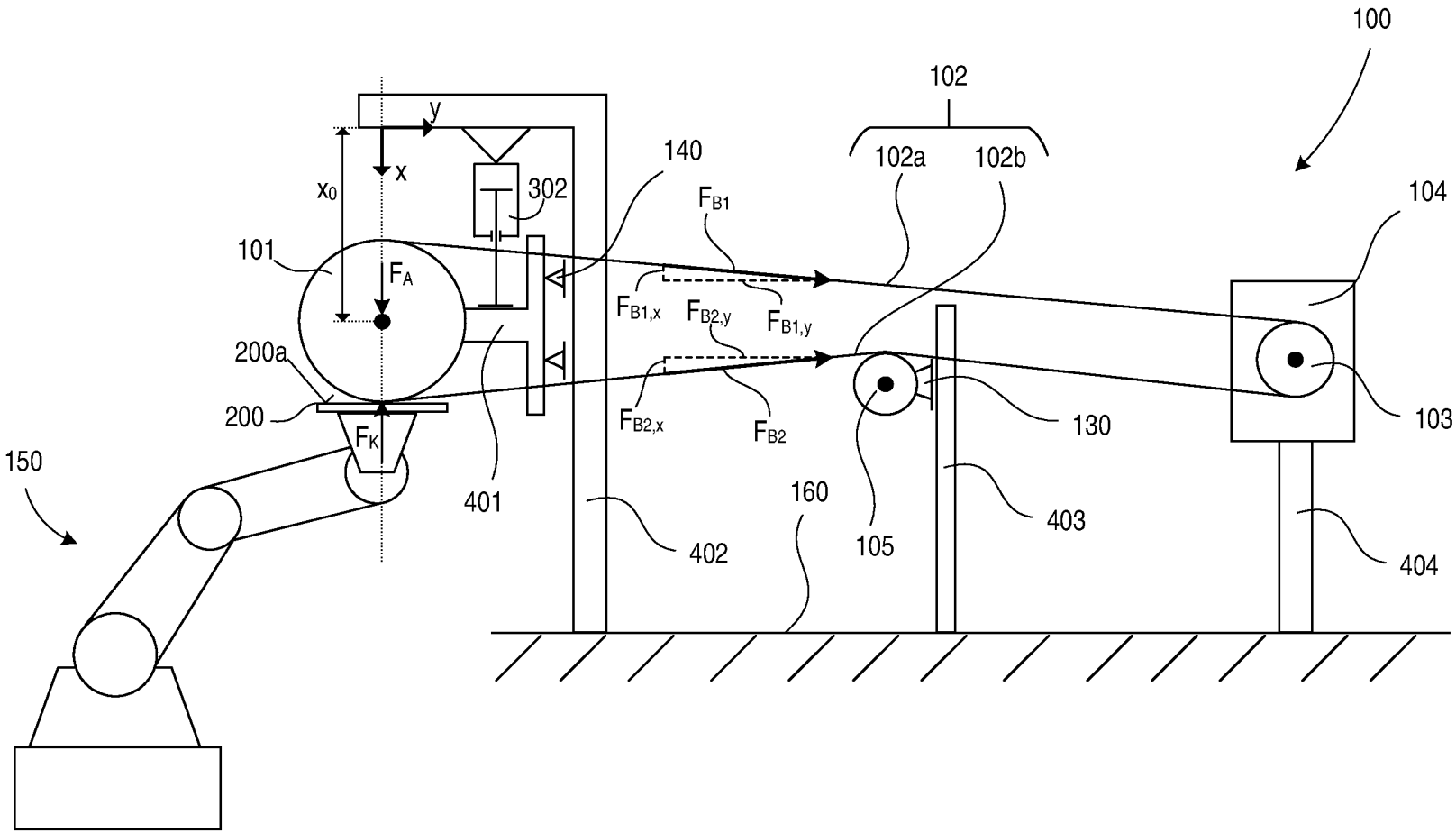
FIG. 5 shows a further embodiment in which the resulting tension in the grinding belt and the contact force between the workpiece and the grinding device are approximately orthogonal to each other.

FIG. 5 shows an alternative embodiment of the grinding device 100, which is also suitable for decoupling the actuator force $F_A$ and the belt forces $F_{B1}$, $F_{B2}$. In essence, the grinding device 100 is constructed in the same manner as in the previous example shown in FIG. 4. However, the linear guide 140 of the roller carrier 401 and the actuator 302 are turned by 90 degrees as compared to the example of FIG. 4. The frame 160 includes for this purpose an arm 402 on which the roller carrier 401 is rotatably supported (by means of the linear guide 140). The actuator 302 acts in the vertical direction (x-direction) between the arm 402 of the frame 160 and the roller carrier 401. The coordinate system is also turned by 90 degrees with respect to the previous example, so that the operating direction of the actuator 302, as in the previous example, is the x-direction. Additional deflection rollers are not necessarily needed in this embodiment. The grinding belt 102 is only led around the deflection roller 101 and the roller 103 (driven by the motor 104). As in the previous examples, a tensioning device with a tensioning roller 105 provides the necessary tension of the grinding belt 102.

Figure 6:
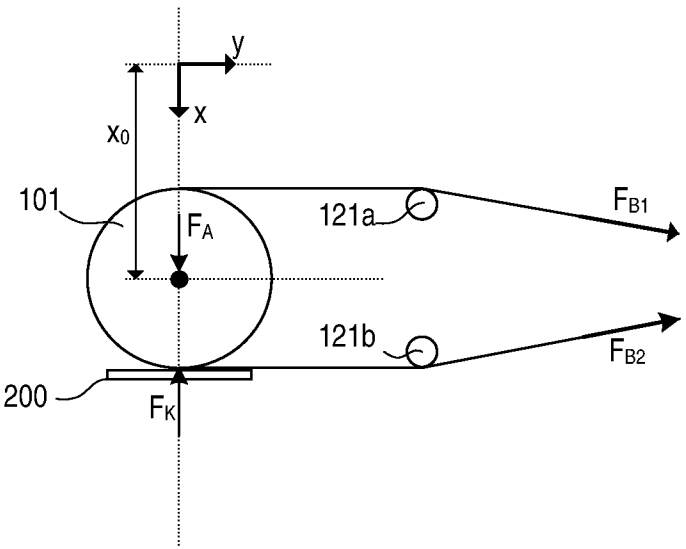
FIG. 6*a* shows a detail of the device of FIG. 5 to better illustrate the forces acting on the rollers and FIG. 6*b* shows an alternative to FIG. 6*a*.
Figure 6:
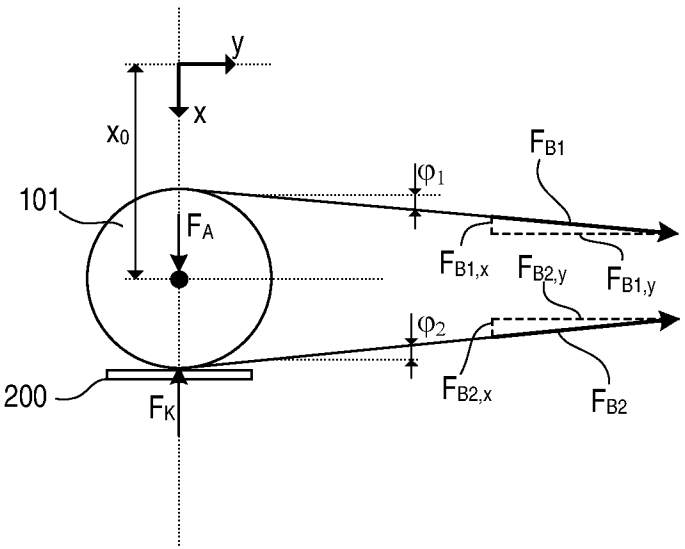

The belt forces acting on the slidably supported deflection roller are designated $F_{B1}$ (force in the upper belt part) and $F_{B2}$ (force in the lower belt part). The force components $F_{B1,x}$ and $F_{B2,x}$ in the x-direction compensate for each other at least partially ($F_{B1,x}>0$ and $F_{B2,x}<0$), so that the resultant force component in x-direction $F_{B1,x}+F_{B2,x}$ is negligibly small. With a suitable design of the grinding device, the resultant force $F_{B1,x}+F_{B2,x}$ is equal to zero and there is no retroactive effect of the belt forces $F_{B1}$ and $F_{B2}$ on the actuator 302. FIG. 6*a* corresponds to the situation in FIG. 5, in which the grinding belt (in reference to the y-axis) runs at an angle $\varphi_2$ to, and at an angle $\varphi_1$ from the deflection roller 101 (clockwise direction of rotation). The force component in the x-direction of the upper belt force $F_{B1}$ is thus $|F_{B1}|\cdot\sin(\varphi_1)$, and the force component in x-direction of the lower belt force $F_{B2}$ is equal to $-|F_{B2}|\cdot\sin(\varphi_2)$. With a suitable design of the grinding device, the resulting belt force disappears in the x-direction $|F_{B1}|\cdot\sin(\varphi_1)-|F_{B2}|\cdot\sin(\varphi_2)$ and there is no retroactive effect on the actuator 302 (for example, because $\varphi_1=\varphi_2$ and $|F_{B1}|=|F_{B2}|$). In the modified example of FIG. 6*b* two deflection rollers 121*a* and 121*b*, fixedly mounted on the frame 160, ensure that the angles $\varphi_1$ and $\varphi_2$ equal zero and that the belt thus runs to and from the roller 101 horizontally. Accordingly, in this case the resulting belt forces in the x direction are zero, provided that the workpiece, and thus the actuator 302 are at the operating point ($x=x_0$). However, as explained with reference to the previous example (FIG. 3), this is set by means of the manipulator 150.

Figure 7:
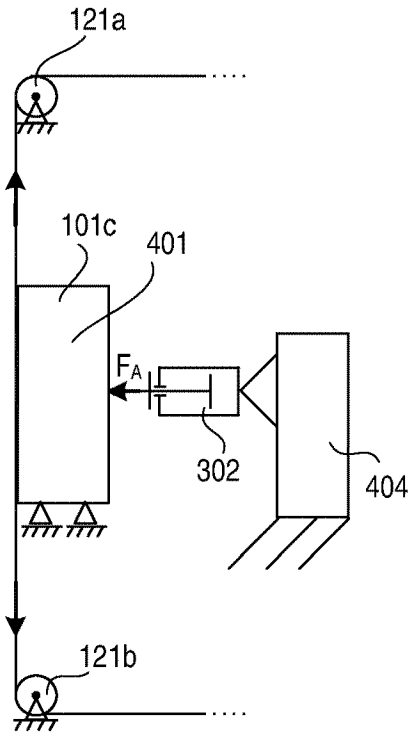
FIG. 7 shows a further embodiment as an alternative to the example of FIG. 3.
Figure 7:
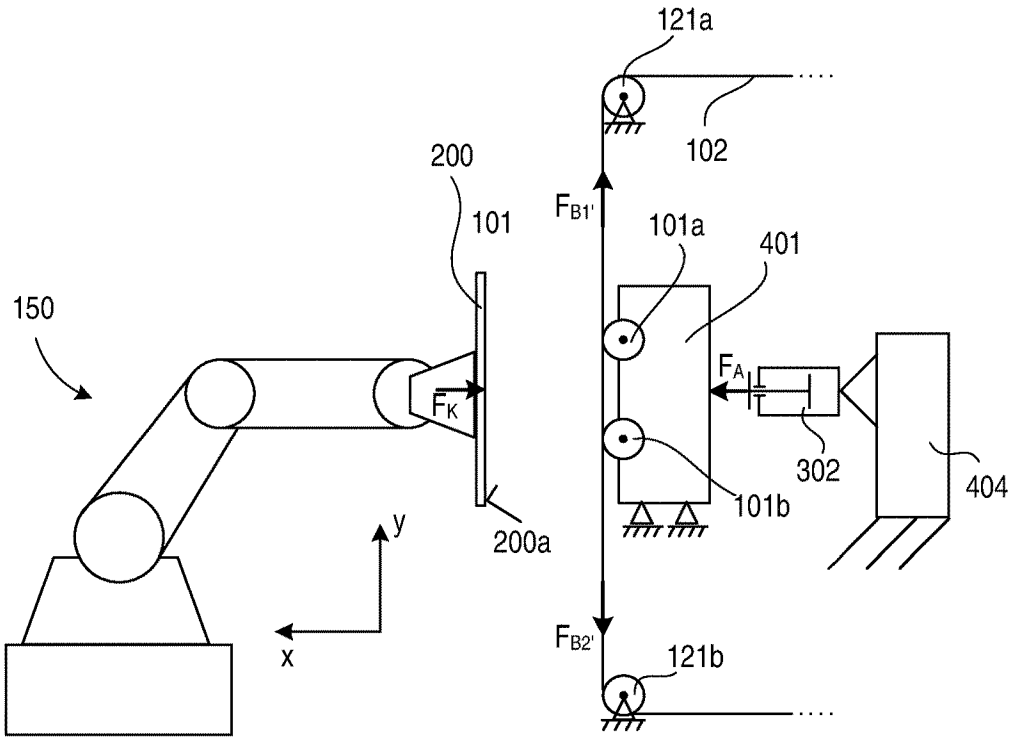

FIGS. 7*a* and 7*b* show further embodiments that are constructed similarly to the example of FIG. 3. In the example in FIG. 7*a* two rollers 101*a* and 101*b* are provided on the roller carrier 401, on which the actuator 302 acts. The belt 102 runs over the two rollers 101*a*, 101*b* substantially perpendicular to the operating direction of the actuator 302. The workpiece 200 can be machined (e.g. ground or polished) between the rollers 101*a*, 101*b*; the belt can adapt to the contour of the workpiece 200. Beyond this, the example of FIG. 7*a* is constructed the same as the embodiment of FIG. 3. In order to avoid repetition, reference is therefore made to the explanations concerning FIG. 3. The alternative of FIG. 7*b* substantially corresponds to the previous example of FIG. 7*a*, with the only difference that no rollers are arranged on the carrier 401'. Instead, the carrier 401' (gliding carriage) has a gliding surface 101*c* along which the belt can glide at a substantially right angle to the effective direction of the actuator 302. In both examples, the belt 102 runs, in the operating point, substantially perpendicular to the operating direction of the actuator 302. The actuator force $F_A$, and the contact force (retroactive force) $F_K$ ($F_K=-F_A$) are thus decoupled from the belt forces $F_{B1}'$, $F_{B2}'$, in the sense that the belt forces $F_{B1}'$, $F_{B2}'$ have not retroactive effect on the actuator 302.

Figure 8:
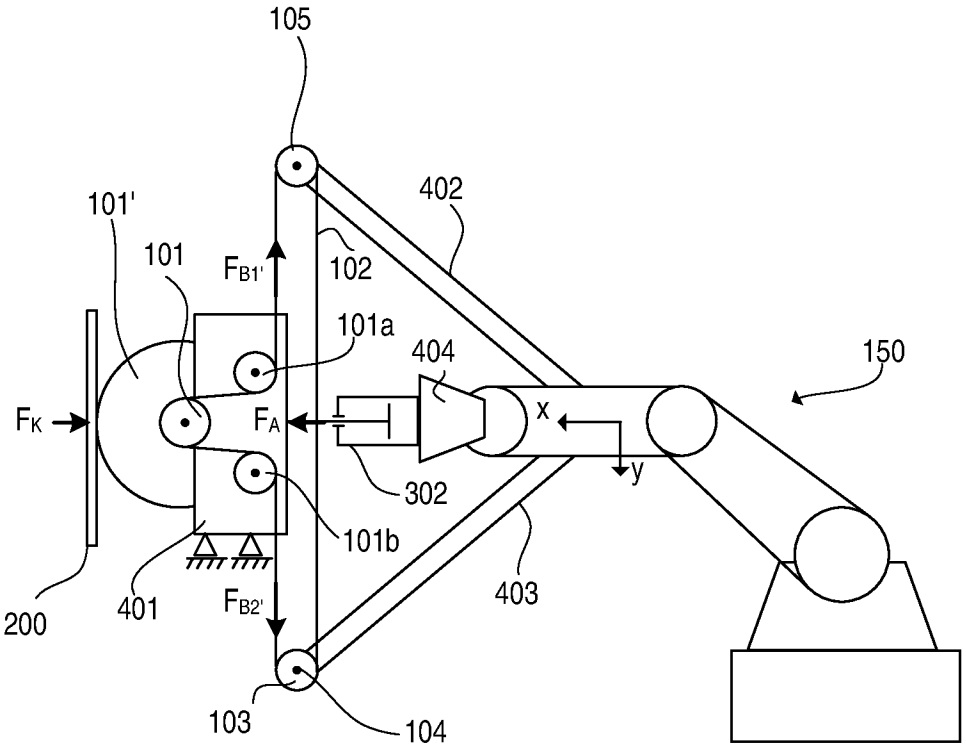
FIG. 8 shows a variation in which not the work piece, but the grinding device is guided by a manipulator.

Unlike the preceding embodiments, in the embodiment according to FIG. 8, it is not the workpiece that is guided by the manipulator 150, but the grinding machine. The frame 160 (cf. e.g. FIG. 3) is thus part of the manipulator 150 and/or rigidly attached (to the Tool Center Point TCP) thereof. The workpiece 200 may be arranged on a firm base (not shown). Similarly as in the example of FIG. 3, two further deflection rollers 101*a* and 101*b* are arranged on a roller carrier 401 next to the deflection roller 101. Further, two more deflection rollers 105 and 103 are provided which are supported on the manipulator 150 (a, frame 160) by means of the roller carriers 402 and 403. As in the example of FIG. 3, the roller 4 can be driven by a motor. The motor (not explicitly shown) can also be mounted on the carrier 402. The roller 105 on the roller carrier 402 may be designed as a tension roller. Alternatively, a tensioning unit for tensioning the belt 102 may be integrated on the motor. In this case the roller 105 would be a simple deflection roller.

The roller carrier 401 with the rollers 101, 101*a* and 101*b* is, similar to the example of FIG. 3, slidably supported on the manipulator, thereby making it possible to move the roller carrier 401 in the x-direction while blocking other degrees of freedom. The carrier 404 is also supported on the manipulator 150. The actuator 302 is arranged on the carrier 404 and acts on the roller carrier 401. Unlike in the preceding examples, in FIG. 8 no grinding belt is used, but rather simple belt. Serving as a tool, a grinding wheel 101' (or other rotating tool) is connected to the front roller 101. As in the previous examples, at an operating point of the actuator (actuator deflection $x=x_0$) the belt runs substantially perpendicular to the operating direction of the actuator, so that the belt forces $F_{B1}'$, $F_{B2}'$ are decoupled from the actuator force and no retroactive effect of the belt forces $F_{B1}'$, $F_{B2}'$ is exerted on the actuator 302.

Figure 9:
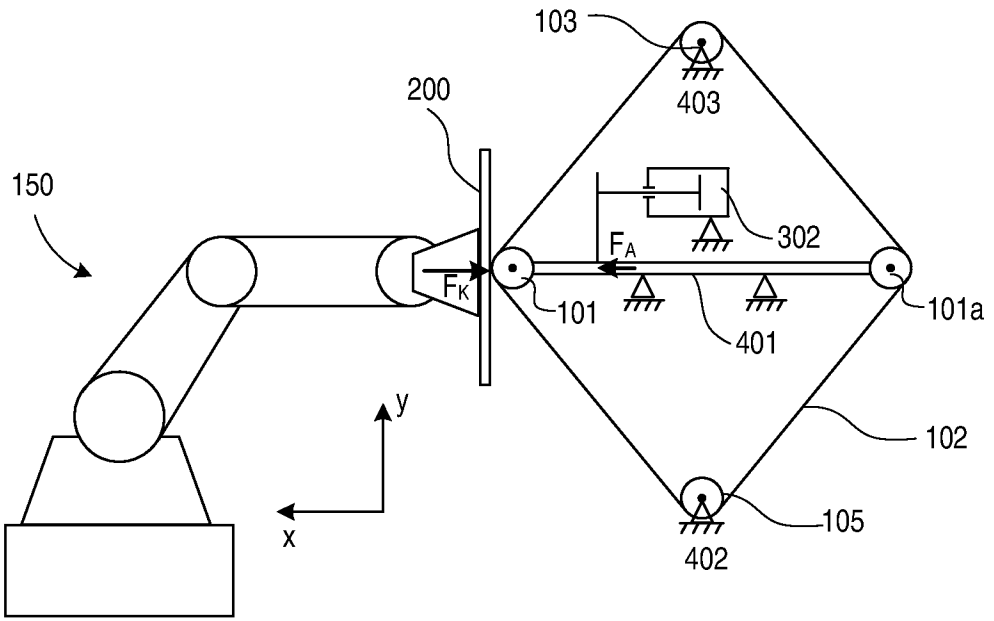
FIG. 9 shows an alternative example for the decoupling of belt forces and actuator force.

FIG. 9 shows another example in which two rollers 101, 101*a* are arranged on opposite ends of an elongated roller carrier 401. The roller carrier is slidably supported on the frame 160 (cf. FIG. 3, not shown in FIG. 9). Two additional rollers 103 and 105 are also supported on the frame (carriers 403 and 402), wherein the roller 105 may be driven by a motor (cf. FIG. 3, not shown in FIG. 9) and the other roller 103 may be a part of the tensioning unit for tensioning the circulating belt 102. Alternatively, the tensioning unit can also be integrated in the drive (roller 105). The slidable roller carrier 401 (gliding carriage) is disposed between the rollers 103 and 105; the belt running around the rollers 101, 103, 101*a*, 105 belt forms, in the cross-sectional view, an approximately convex quadrilateral. Based on the illustration is clear that the belt forces acting on the roller carrier 401 cancel each other in the operating direction of the actuator 302, and have no retroactive effect on the actuator 302 that acts on the roller carrier 401. The actuator presses with a force $F_A$ on the roller carrier 401, and thus presses the roller 101 onto the workpiece. The contact force $F_K$ (retroactive force) corresponds to the actuator force $F_A$ ($F_K=-F_A$).

According to FIG. 9, the workpiece is guided by a manipulator 150 and positioned such that the deflection x of the actuator 302 is located in a defined operating point $x_0$. The actuator 302 operates purely force-regulated; the position is determined by the (position-controlled) manipulator 150. Small deviations from the operating point (for example, due to the form and positional tolerances of the workpiece or due to limited positioning accuracy of the manipulator 150) lead to no significant change in the geometry of the device and the belt forces, so that the grinding force can always be set by the force controlled actuator 302.

Figure 10:
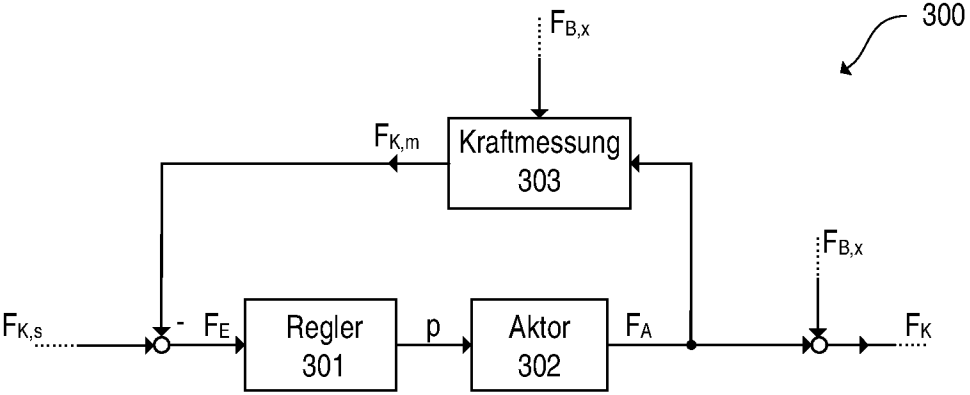
FIG. 10 shows a block diagram concerning the control of the contact force in a device according to the illustrated embodiments.

FIG. 10 shows an example of a control circuit for controlling the contact force $F_K$ between the workpiece 200 and the grinding belt 102 on the deflection roller 101. With complete decoupling between actuator force $F_A$ and the resulting belt force $F_{B,x}$ in the operating direction of the actuator (x-direction), the actuator force $F_A$ and the contact force $F_K$ are equal in magnitude, but oppositely oriented, that is, $-F_K=F_A$. If a part of the resulting belt force $F_B$ reacts back on the actuator 302, the magnitude of the contact force will be the sum of the actuator force $F_A$ and the resultant belt force in the operating direction of the actuator $F_{B,x}$, i.e. $-F_K=F_A+F_{B,x}$.

The force measurement (load unit 303) can be conducted directly via a force sensor integrated in or coupled with actuator 302. In a pneumatic actuator, however, the force can also be measured indirectly via the pressure p in the pneumatic actuator, taking into account the deflection x of the actuator 302. That is, the actuator force $F_A(p, x)$ is a function of pressure p in the actuator (for example, in the pneumatic piston) and the deflection x of the actuator. From the measured actuator force $F_A$, the sought measurement value $F_{K,m}$ for the contact force can be determined. With a decoupling between the resultant belt force $F_B$ and the actuator force $F_A$, $F_{K,m}=-F_A(p, x)$ applies. If no complete decoupling between actuator force $F_A$ and the resultant belt force $F_{B,x}$ in the operating direction of the actuator 320 is given, an estimation or a separate measurement of the resultant belt force can be taken into account when measuring the contact force. In this case, $F_{K,m}=-F_A(p, x)-F_{B,x}$ applies for the measured value. From the measured value $F_{K,m}$ for the contact force and a corresponding reference value $F_{K,s}$, a control error $F_E$ can be calculated ($F_E=F_{K,s}-F_{K,m}$) which is supplied to the controller 301 at the input side. The controller 301 may be, for example, a P controller, a PI controller or a PID controller. However, other types of controllers can also be used.

The invention claimed is:

1. A device for machining a surface of a workpiece, the device comprising:

a frame;

a roller carrier, on which a first roller is rotatably supported and which is supported on the frame slidably along a first direction;

a second roller supported on the frame;

a belt led around the first roller and the second roller, a tension of the belt resulting in a belt force acting on the roller carrier; and an actuator mechanically coupled with the frame and the roller carrier such that an adjustable actuator force acts between the frame and the first roller along the first direction, wherein the belt, with the aid of the second roller or with the aid of the second roller and further rollers, is guided such that the resulting belt force acting on the roller carrier at a desired deflection of the actuator is approximately in a second direction orthogonal to the first direction, wherein at the desired deflection of the actuator the belt runs to the roller carrier and from the roller carrier at approximately a right angle to the first direction.

2. The device of claim 1, further comprising:

a force measuring device configured for direct or indirect measurement of a contact force between the first roller and the workpiece, or between a rotating tool connected with the first roller and the workpiece; and a control unit configured to control the adjustable actuator force such that the contact force corresponds to a pre-determinable desired value.

3. The device of claim 2, wherein the actuator is a pneumatic linear actuator, and wherein the force-measuring device comprises a pressure sensor configured to measure air pressure in the pneumatic linear actuator.

4. The device of claim 1, wherein the first roller is supported on the roller carrier rotatably about an axis of rotation, and wherein the roller carrier is configured to slide by means of a linear guide along the first direction relative to the frame.

5. The device of claim 1, wherein the actuator operates purely force-regulated.

6. The device of claim 1, wherein the first roller is mounted at a first end of the roller carrier and a further roller is mounted at a second end opposite the first end of the roller carrier, and wherein the belt, at a nominal deflection of the actuator, is symmetrically led around the first roller and the further roller such that the resulting belt force on the roller carrier in the first direction is zero or negligibly small.

7. The device of claim 1, wherein the roller carrier has one or more deflection rollers configured to deflect the belt, wherein the one or more deflection rollers are arranged such that, at a nominal deflection of the actuator, the belt runs to the roller carrier and from the roller carrier in the second direction.

8. The device of claim 1, further comprising a tensioning roller configured to adjust a tension force in the belt.

9. A method for surface machining of a workpiece using an apparatus that includes a frame, a roller carrier, on which a first roller is rotatably supported and which is supported on the frame slidably along a first direction, an actuator mechanically connected with the frame and the roller carrier, and a belt led at least around the first roller and which exerts a resulting belt force on the roller carrier, the method comprising:

positioning the workpiece on the first roller;

measuring a contact force between the first roller and the workpiece; and setting a contact force between the first roller and the workpiece by adjusting a force acting between the frame and the actuator, wherein when positioning the workpiece, the workpiece is positioned relative to the apparatus such that the deflection of the actuator corresponds to a desired deflection, at which the resulting belt force acting on the roller carrier acts approximately in a second direction which is orthogonal to the first direction, wherein at the desired deflection of the actuator the belt runs to the roller carrier and from the roller carrier at approximately a right angle to the first direction.

10. The method of claim 9, wherein a retroactive effect of the resulting belt force on the actuator is, at the desired deflection, approximately zero.

11. The method of claim 9, wherein the actuator is a pneumatic linear actuator, and wherein measuring the contact force between the first roller and the workpiece comprises measuring pressure in the pneumatic linear actuator.

12. The method of claim 9, wherein the actuator operates purely force-regulated.

13. A system for robotic surface machining of workpieces, the system comprising:

a machining apparatus; and a manipulator configured to position the workpiece relative to the machining apparatus, wherein the machining apparatus comprises:

a frame;

a roller carrier, on which a first roller is rotatably supported and which is supported on the frame slidably along a first direction;

a second roller supported on the frame;

a belt led around the first roller and the second roller, a tension of the belt resulting in a belt force acting on the roller carrier; and an actuator mechanically coupled with the frame and the roller carrier such that an adjustable actuator force acts between the frame and the first roller along the first direction, wherein the belt, with the aid of the second roller or with the aid of the second roller and further rollers, is guided such that the resulting belt force acting on the roller carrier at a desired deflection of the actuator is approximately in a second direction orthogonal to the first direction, wherein at a desired deflection of the actuator the belt runs to the roller carrier and from the roller carrier at approximately a right angle to the first direction.

14. The system of claim 13, wherein the manipulator is configured to position the workpiece relative to the machining apparatus such that the deflection of the actuator corresponds to a desired deflection.

15. The system of claim 13, wherein the actuator operates purely force-regulated, wherein the position is determined by the position-controlled manipulator.

16. An apparatus for machining a surface of a workpiece, the apparatus comprising:

a frame;

a first roller supported on the frame slidably along a first direction;

a second roller rigidly mounted to the frame;

a belt led around the first roller and the second roller;

an actuator mechanically connected with the frame and the first roller such that an adjustable actuator force acts between the frame and the first roller along the first direction;

a force measuring device configured for direct or indirect measurement of a contact force between the first roller and the workpiece, or between a rotating tool connected with the first roller and the workpiece; and a control unit configured to control the adjustable actuator force such that the contact force corresponds to a pre-determinable desired value, wherein at a nominal deflection of the actuator, the belt runs to the first roller and away from the first roller in a second direction which is orthogonal to the first direction.

17. The apparatus of claim 16, wherein the first roller is supported on a roller carrier rotatably about an axis of rotation, and wherein the roller carrier is configured to slide by means of a linear guide along the first direction relative to the frame.

18. The apparatus of claim 16, further comprising a tensioning roller configured to adjust a tension force in the belt.

19. The apparatus of claim 16, further comprising a manipulator configured to position the workpiece relative to the first roller.

20. The apparatus of claim 19, wherein the position is determined by the position-controlled manipulator.

21. The apparatus of claim 16, wherein the actuator operates purely force-regulated.

22. A method for machining the surface of a workpiece using an apparatus that includes a frame, a first roller supported on the frame slidably along a first direction, a second roller rigidly mounted on the frame, a belt led around the first roller and the second roller, and an actuator mechanically coupled with the frame and the first roller, the method comprising:

measuring a contact force between the first roller and the workpiece; and adjusting an actuator force which acts between the frame and the first roller along the first direction, wherein the actuator force is controlled such that the contact force corresponds to a pre-determinable desired value, wherein at a nominal deflection of the actuator, the belt runs to the first roller and away from the first roller in a second direction which is orthogonal to the first direction.

23. The method of claim 22, wherein the belt is guided such that a resulting belt force acting on the actuator is, in an operating direction of the actuator and at a nominal deflection of the actuator, substantially zero.

24. A surface machining device, comprising:

a drive configured to drive a belt;

a first roller driven by the belt, the roller being supported on a frame slidably in a first direction; and an actuator coupled between the frame and the first roller and configured to affect an actuator force acting on the first roller, wherein the belt is configured to cause a resulting belt force that acts on the first roller along a second direction which is substantially orthogonal to the first direction at a nominal displacement of the actuator, wherein at a nominal deflection of the actuator, the belt runs to the first roller and away from the first roller in a second direction which is orthogonal to the first direction.

25. An apparatus for machining a surface of a workpiece, the apparatus comprising:

a frame;

a first roller supported on the frame slidably along a first direction;

a second roller rigidly mounted to the frame;

a belt led around the first roller and the second roller;

an actuator mechanically connected with the frame and the first roller such that an adjustable actuator force acts between the frame and the first roller along the first direction;

a force measuring device configured for direct or indirect measurement of a contact force between the first roller and the workpiece, or between a rotating tool connected with the first roller and the workpiece; and a control unit configured to control the adjustable actuator force such that the contact force corresponds to a pre-determinable desired value, wherein the first roller is supported on a roller carrier rotatably about an axis of rotation, wherein the roller carrier is configured to slide by means of a linear guide along the first direction relative to the frame, wherein the roller carrier comprises one or more deflection rollers configured to deflect the belt, wherein the one or more deflection rollers are arranged such that, at a nominal deflection of the actuator, the belt runs to the roller carrier and from the roller carrier in a second direction that is orthogonal to the first direction.

26. The apparatus of claim 25, wherein belt forces act on the roller carrier, and wherein a resulting belt force is taken into account when measuring the contact force.

27. The apparatus of claim 26, wherein the resulting belt force is measured or calculated with the aid of a model.

28. The apparatus of claim 25, wherein belt forces act on the roller carrier, and wherein a resulting belt force, at a nominal deflection of the actuator, has no force component or a negligibly small force component in the first direction.

29. The apparatus of claim 25, wherein the first roller is supported at a first end of the roller carrier and a further roller is supported at a second end opposite to the first end of the roller carrier, and wherein the belt, at a nominal deflection of the actuator, is led symmetrically around the first roller and the further roller such that the resulting belt force on the roller carrier in the first direction is zero or negligible small.

30. The apparatus of claim 25, wherein the roller carrier comprises one or more deflection rollers configured to deflect the belt, and wherein the one or more deflection rollers are arranged such that, at a nominal deflection of the actuator, the belt runs to the roller carrier and from the roller carrier in a second direction that is orthogonal to the first direction.

31. The apparatus of claim 25, wherein the actuator operates purely force-regulated.

* * * * *